US005967298A

United States Patent [19]

Watanabe et al.

[11] Patent Number: 5,967,298

[45] Date of Patent: Oct. 19, 1999

[54] KEYBOARD DEVICE

[75] Inventors: Kazutoshi Watanabe; Tsuyoshi Narusawa, both of Fukushima-ken, Japan

[73] Assignee: Alsp Electric Co., Ltd., Tokyo, Japan

[21] Appl. No.: 08/909,013

[22] Filed: Aug. 8, 1997

[30] Foreign Application Priority Data

Aug. 21, 1996 [JP] Japan ..... 8-238435

[51] Int. Cl.[6] ..... H01H 13/70

[52] U.S. Cl. ..... 200/344; 200/345

[58] Field of Search ..... 200/344, 341, 200/345, 520, 512

[56] References Cited

U.S. PATENT DOCUMENTS 5,280,147 1/1994 Mochizuki et al. ..... 200/344
5,457,297 10/1995 Chen ..... 200/344
5,630,501 5/1997 Tsay ..... 200/344

*Primary Examiner*—David J. Walczak
*Attorney, Agent, or Firm*—Brinks Hofer Gilson & Lione

[57] ABSTRACT

In conventional keyboard devices, since an elastic member is disposed between an insulating substrate and the central crossing part of levers, it is impossible to realize a thin keyswitch, and a high cost is required to modify the height of the keyswitch to a desired value required in a specific application. The invention provides a keyboard device having no such problems. In the keyboard device of the invention, a first and second levers are combined with each other via a shaft such that they cross each other; an elastic member is disposed in a hollow formed in the first or second lever; and the top portion of the elastic member is in contact with the pedestal formed on the back surface of the keytop. This structure allows a reduction in space between the keytop and the top portion of the elastic member. Thus, it is possible to realize a thin-type keyboard device, and it is also possible to accommodate the requirement of various heights of keyswitches simply by making a modification on the keytop. This allows a reduction in production cost.

2 Claims, 3 Drawing Sheets

KEYBOARD DEVICE

BACKGROUND OF THE INVENTION

1. Field of the Invention

The present invention relates to a keyboard device suitable as an input/output device for use in a word processor, personal computer, or the like.

2. Description of the Related Art

FIG. 6 illustrates a keyboard device used as an input/output device. In this keyboard device, switch elements are constructed by placing a flexible insulating substrate 51, having a circuit (not shown) formed thereon, onto an insulating substrate 50 on which a conductor (not shown) is formed.

Each supporting member 52 is made of a synthetic resin in such a manner so as to include: a holding element 52*a* having a hole; a holding element 52*c* having a sliding slot 52*b*; and a cut-away part 52*d* formed between the holding elements 52*a* and 52*c*. These components are combined into a single supporting member 52. A plurality of similar supporting members are produced and placed on the insulating substrate 51.

First and second levers 53 and 54 are connected to each other via a shaft 55 such that they cross each other, wherein one end of the first lever 53 is slidably fit into the sliding slot 52*b* and one end of the second lever 54 is pivotably fit into the holding element 52*a*.

Each keytop 56 is made up of a synthesis resin in such a manner as to include: a holding element 56*a* having a hole and a holding element 56*c* having a sliding slot 56*b* wherein the holding elements 56*a* and 56*c* are disposed on the back surface of each keytop 56. The other end of the first lever 53 is pivotably fit into the holding element 56*a* and the other end of the second lever 54 is slidably fit into the holding element 56*c* thereby fixing the keytop to the first and second levers 53 and 54.

Dome-shaped elastic members 57 made of electrically insulating rubber are placed on the insulating substrate 51 in such a manner that they are located in the cut-away parts 52*d* of the respective supporting members 52. The top portion 57*a* of each elastic member 57 is in contact with the central crossing part of the first and second levers 53 and 54.

A plurality of key units each consisting of first and second levers 53 and 54, a keytop 56 fixed to the levers 53 and 54, and an elastic member 57 are disposed on the switch elements along a plurality of lines.

In the keyboard device constructed in the above-described manner, if a certain keytop 56 is pressed, the first and second levers 53 and 54 rotate about the shaft 55 and also pivot at their one end fit in the holding elements 52*a* and 56*a*, respectively. The other end of the first lever 53 slides in the sliding slot 52*b* and the other end of the second lever 54 slides in the sliding slot 56*b*. Thus, the first and second levers 53 and 54 move downward. As a result, the keytop 56 also moves downward while maintaining itself horizontal. As a result of the downward movement of the first and second levers 53 and 54, the top portion 57*a* of the elastic member 57 is pressed by the central crossing part 58 of the first and second levers 53 and 54, and finally the dome-shaped elastic member 57 is inverted in shape. As a result, the insulating substrate 51 is pressed by the elastic member 57 and the corresponding electric contact formed on the insulating substrate 51 comes in contact with the conductor disposed on the insulating substrate 50. Thus, a corresponding switch element is turned on.

If the pressing force against the keytop 56 is removed, the first and second levers 53 and 54 and the keytop 56 are pushed back by the elastic force of the elastic member 57 to their original positions where they were located before being pressed. The pressure by the elastic member 57 against the insulating substrate 51 is released and the insulating substrate 51 returns to its original position by its own restoring force. As a result, the contact with the conductor on the insulating substrate 50 is released and thus the switch element is turned off.

In the conventional keyboard device described above, since the dome-shaped elastic members 57 for actuating the corresponding switch elements are disposed between the insulating substrate 51 and the central crossing parts 58 of the first and second levers 53 and 54, the height H of the upper surface of the keytop relative to the insulating substrate 51 becomes great, and thus it is difficult to achieve a thin keyboard device.

Furthermore, since the elastic members 57 are simply placed in the cut-away parts 52*d* of the supporting members 52 on the insulating substrate 51, when the first and second levers 53 and 54 are attached to the supporting members 52 after the elastic members have been placed, the elastic members 57 move from their right position. Therefore, it is required to correct the position of the elastic members 57, and thus the assembling process is inefficient.

Furthermore, in the conventional keyboard device, it is required to modify the height H in accordance with specific applications. To this end, it is required to prepare various sizes of components including supporting members 52, first and second levers 53 and 54, and keytops 56. This causes an increase in cost, and makes it impossible to standardize the components. As a result, it is impossible to assemble the components into a keyboard device in an efficient manner.

SUMMARY OF THE INVENTION

According to a first aspect of the invention, there is provided a keyboard device including: a keytop a first lever, one end of said first lever being slidably held by a supporting member, the other end of said first lever being pivotably held by the back side of said keytop; a second lever, one end of said second lever being pivotably held by said supporting member, the other end of said second lever being slidably held by the back side of said keytop; and a dome-shaped elastic member placed on an insulating substrate; wherein said first and second levers are combined with each other via a shaft such that they cross each other; said elastic member is located in a hollow formed in said first or second lever; and the top portion of said elastic member is in contact with the back surface of said keytop.

According to a second aspect of the invention, there is provided a keyboard device including: a keytop having a pedestal formed on its back surface; a first lever, one end of said first lever being slidably held by a supporting member, the other end of said first lever being pivotably held by the back side of said keytop; a second lever, one end of said second lever being pivotably held by said supporting member, the other end of said second lever being slidably held by the back side of said keytop; and a dome-shaped elastic member placed on an insulating substrate; wherein said first and second levers are combined with each other via a shaft such that they cross each other; said elastic member is located in a hollow formed in said first or second lever; and the top portion of said elastic member is in contact with said pedestal on the back surface of said keytop.

According to a third aspect of the invention, there is provided a keyboard device based on the first or second aspect, in which a recess is formed in the top portion of said elastic member, and a projection formed on the back surface of said keytop is fit into said recess.

According to a fourth aspect of the invention, there is provided a keyboard device based on the first, second, or third aspect, in which a flange is formed in an integral fashion on said elastic member, and said flange is held between said insulating substrate and said supporting member.

DESCRIPTION OF THE PREFERRED EMBODIMENTS

Figure 1:
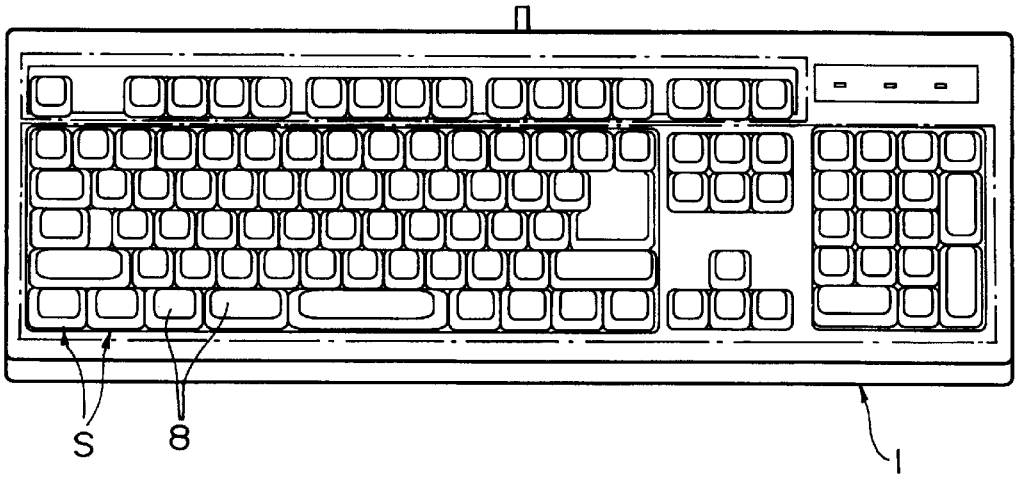
FIG. 1 is a plan view of a keyboard device according to the invention.
Figure 2:
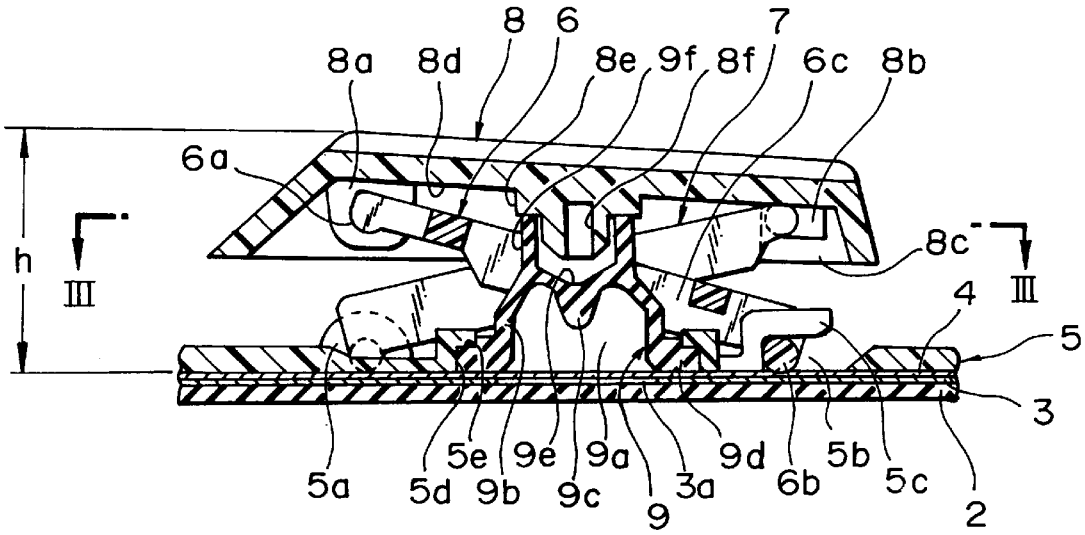
FIG. 2 is a cross-sectional view illustrating the main parts of a keyboard device according to the invention.
Figure 3:
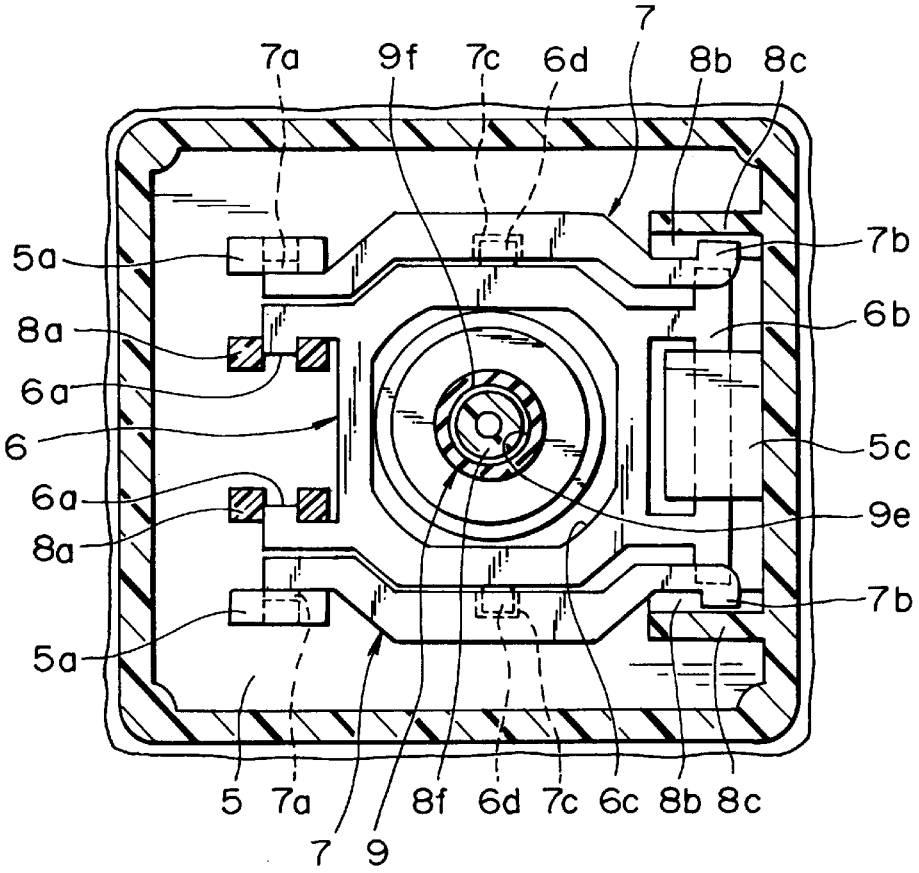
FIG. 3 is a cross-sectional view of the keyboard device taken along line III—III of FIG. 2.

Referring to FIGS. 1–3, an embodiment of a keyboard device according to the invention will be described below. As shown in FIG. 1, the keyboard device includes a plurality of keyswitches S disposed on its enclosure 1 along a plurality of lines.

Each keyswitch S has its own switch element constructed by placing a flexible insulating substrate 4 having a circuit (not shown) formed thereon onto an insulating substrate 2 having a conductor (not shown) formed thereon, wherein a plate-shaped spacer 3 made up of an insulating material having a hole 3*a* is disposed between the insulating substrates 4 and 2.

A supporting member 5 is made of a synthetic resin in such a manner as to include: two holding elements 5*a* each having a hole and disposed apart from each other; a holding element 5*c* having a sliding slot 5*b* and disposed apart from the above holding elements 5*a*; and a circular-shaped hole 5*d* and a fixing element 5*e* having an L-shape cross section, formed between the holding element 5*c* and the holding elements 5*a*. The supporting member 5 is placed on the insulating substrate 4.

A first lever 6 is formed into a substantially square shape using a synthesis resin. The first lever 6 includes circular projections 6*a* located at its one end; a bar-shaped connecting element 6*b* located at the opposite end; a hollow 6*c* formed in the center; and outward-projecting shafts 6*d* located between the one end and the opposite end. The connecting element 6*b* is held by the holding element 5*c* of the supporting member 5 in such a manner that the connecting element 6*b* can slide in the sliding slot 5*b*.

Furthermore there is provided a pair of second levers 7 each made up of a synthetic resin and including: circular projections 7*a* and 7*b* formed at either end; and a hole 7*c* formed at a location between the projections 7*a* and 7*b*. The projection 7*a* is fit into the hole of the holding element 5*a* of the supporting member 5, and the hole 7*c* receives the shaft 6*d* of the first lever 6 so that the first and second levers 6 and 7 are combined into a crossing form.

Each keytop 8 is made of a synthesis resin into a boat shape. The keytop 8 has, on its back side, two holding elements 8*a* each having a hole; two L-shaped holding elements 8*c* each having a sliding slot 8*b*; a rather thin circular-shaped pedestal 8*e* formed at the center of the back surface 8*d* of the keytop 8; and a projection 8*f* formed in the center of the pedestal 8*e*.

The projections 6*a* of the first lever 6 are fit into the corresponding holes of the holding elements 8*a* of the keytop 8, and the projection 7*b* of each of the two second levers 7 is fit into the sliding slot 8*b* of the corresponding holding element 8*c* of the keytop 8 so that the keytop 8 is fixed to the first and second levers 6 and 7.

As shown in FIGS. 2 and 3, a dome-shaped elastic member 9 is made of electrically insulating rubber in such a manner as to include: a trunk 9*b* having a cavity 9*a*; a projecting part 9*c* formed in the cavity 9*a*; a ring-shaped flange 9*d* formed at the bottom of the trunk 9*b*; and a top portion 9*f* having a recess 9*e* and disposed at the top of the trunk 9*b*.

The ring-shaped flange 9*d* of the elastic member 9 is held between the insulating substrate 4 and the fixing element 5*e* of the supporting member 5 so that the elastic member 9 cannot move in either a vertical or horizontal direction. The trunk 9*b* and the top portion 9*f* of the elastic member 9 are located in the hollow 6*c* of the first lever 6 in such a manner that the projection 8*f* of the keytop 8 is fit into the recess 9*e* of the top portion 9*f* and the end of the top portion 9*f* is in contact with the pedestal 8*e* of the keytop 8 and thus the keytop 8 is always pushed upward by the elasticity of the elastic member 9.

As described above, each keyswitch S is constructed with a switch element, first and second levers 6 and 7, a keytop 8, and an elastic member 9.

The operation of the keyboard device constructed in the above-described manner will be described below.

If some keytop 8 is pressed against the elastic force of the elastic member 9, the elastic member 9 is gradually deformed and the dome-shaped trunk 9*b* is finally inverted in shape. As a result, the insulating substrate 4 is pressed by the projecting part 9*c* against the insulating substrate 2 and the electric contact on the insulating substrate 4 comes into contact with the conductor formed on the insulating substrate 2. Thus, the corresponding switch element is turned on.

In the above operation, since the projection 8*f* of the keytop 8 is fit in the recess 9*e* of the elastic member 9, the elastic member 9 is precisely pushed down by the keytop 8.

Furthermore, in the above operation, the first and second levers 6 and 7 rotate about the shaft 6*d* and also pivot at their one end fit in the holding elements 5*a* and 8*a*, respectively. The other end of the first lever 6 slides in the sliding slot 5*b* and the other end of the second lever 7 slides in the sliding slot 8*b*. Thus, the first and second levers 6 and 7 move downward. As a result, the keytop 8 also moves downward while maintaining itself horizontal.

After that, when the pressing force against the keytop 8 is removed, the keytop 8, the first and second levers 6 and 7 are pushed back by the elastic force of the elastic member 9 to their original positions at which they were located before being pressed. The pressure by the elastic member 9 against the insulating substrate 4 is released and the insulating substrate 4 returns to its original position by its own restoring force. As a result, the contact with the conductor on the insulating substrate 2 is released and thus the switch is turned off.

Figure 4:
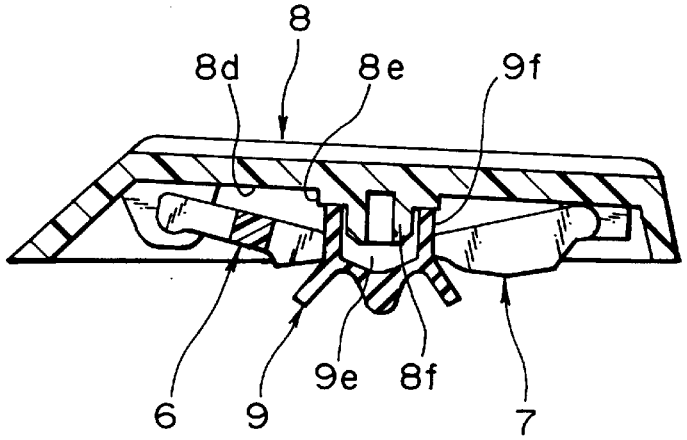
FIG. 4 is a cross-sectional view illustrating the main parts of a keyboard device according to another embodiment of the invention.
Figure 5:
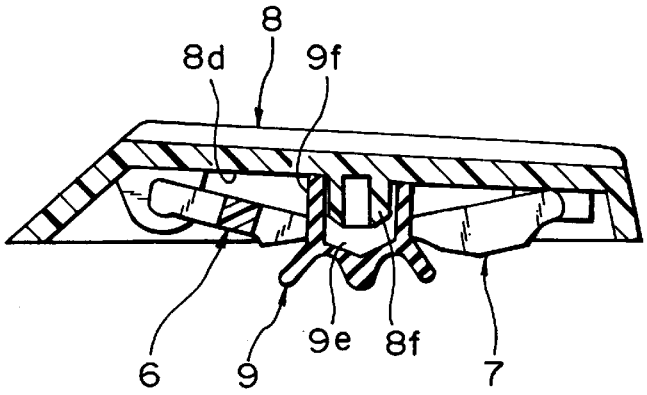
FIG. 5 is a cross-sectional view illustrating the main parts of a keyboard device according to still another embodiment of the invention.
Figure 6:
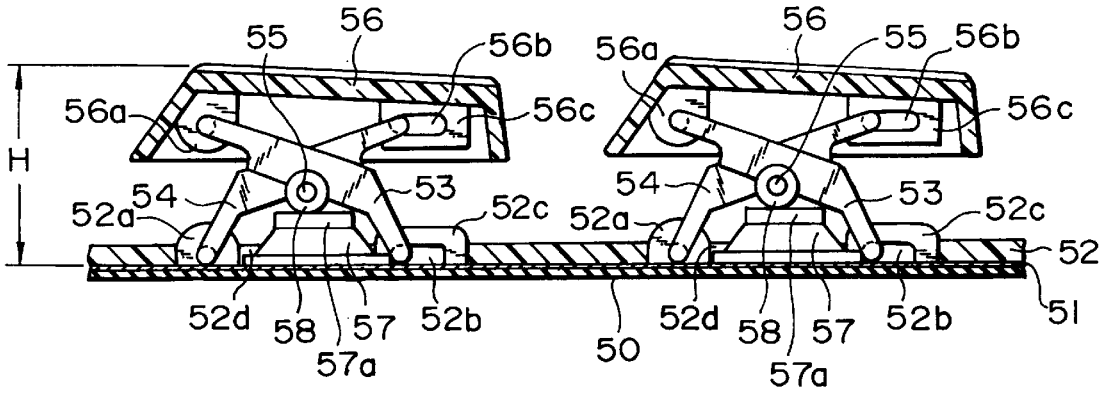
FIG. 6 PRIOR ART
FIG. 6 is a cross-sectional view illustrating the main parts of a keyboard device according to a conventional technique.

FIG. 4 illustrates a keytop 8 for use in a keyboard device, according to another embodiment of the invention. FIG. 5 illustrates a keytop 8 according to still another embodiment of the invention.

In keyboard devices, as described, it is required to adjust the height h of keyswitches S (refer to FIG. 2) in accordance with specific applications.

For example, keyswitches S having a height of 9 mm, 7.5 mm, or less than that, are currently used in practical applications. To meet the requirement of a smaller height h, the keytop 8 shown in FIG. 4 has a pedestal 8*e* with a height smaller than that shown in FIG. 2 and the keytop 8 is combined with the elastic member 9 such that the end of the top portion 9*f* of the elastic member 9 is in contact with the pedestal 8*e*. Except for the above point, the structure is the same as that shown in FIGS. 2 and 3.

This technique makes it possible to reduce the height h by an amount corresponding to the reduction in the height of the pedestal 8*e*. In the keytop 8 shown in FIG. 5, the pedestal 8*e* is removed and the keytop 8 is combined with the elastic member 9 in such a manner that the end of the top portion 9*f* of the elastic member 9 comes in direct contact with the back surface 8*d* of the keytop 8. This allows a further reduction in height h.

As described above, it is possible to meet the requirement of various heights h of the keyswitch S by varying the height of the pedestal 8*e* or removing the pedestal 8*e*. That is, it is possible to accommodate such the requirement simply by making a change only on the keytop 8.

Although in the embodiments described above, the hollow 6*c* is formed in the first lever 6, a hollow may be formed in the second lever 7.

In the present invention, as described above, the first and second levers are combined with each other via the shaft such that they cross each other; the elastic member is disposed in the hollow formed in the first or second lever; and the top portion of the elastic member is in contact with the pedestal on the back surface of the keytop. With this arrangement, the space between the keytop and the top portion of the elastic member can be reduced. This makes it possible to realize a thin-type keyboard device. Furthermore, it is possible to accommodate the requirement of various heights of keyswitches simply by making a modification on the keytop. This allows a reduction in production cost.

In another mode of the invention, the first and second levers are combined with each other via the shaft such that they cross each other; the elastic member is disposed in the hollow formed in the first or second lever; and the top portion of the elastic member is in contact with the pedestal on the back surface of the keytop. This arrangement also provides the advantages that the space between the keytop and the top portion of the elastic member can be reduced, and that it is possible to accommodate the requirement of various heights of keyswitches simply by making a modification on the keytop. This allows a reduction in production cost.

Furthermore, since a recess is formed in the top portion of said elastic member, and a projection formed on the back surface of the keytop is fit into the recess, it is possible to precisely press a desired keytop without encountering a shift in a horizontal direction.

Furthermore, since a flange is formed in an integral fashion on the elastic member, and the flange is held between the insulating substrate and the supporting member, it is possible to properly restrict the motion of the elastic member. This arrangement also makes it easier to assemble the components into keyswitch units.

What is claimed is:

1. A keyboard device comprising:

a keytop, the keytop having a back surface;

a first lever, one end of said first lever being slidably held by a supporting member, the other end of said first lever being pivotably held by the back surface of said keytop, the supporting member have a hole and a fixing portion in close proximity to said hole;

a second lever, one end of said second lever being pivotably held by said supporting member, the other end of said second lever being slidably held by the back surface of said keytop; and a dome-shaped elastic member placed on an insulating substrate, the elastic member having a top portion and a flange portion, said flange portion being formed in an integral fashion on said elastic member and said flange portion being held between said insulating substrate and said supporting member and disposed within said hole, the fixing portion being adapted to retain the flange portion; and wherein said first and second levers are combined with each other via a shaft such that they cross each other; said elastic member is located in a hollow formed in said first or second lever; and the top portion of said elastic member is in contact with the back surface of said keytop.

2. A keyboard device capable of having a plurality of heights comprising:

a keytop having a pedestal formed on its back surface, the pedestal having a thickness, whereby the thickness of the pedestal controls a plurality of heights of the keyboard device, the pedestal further comprising a projection;

a first lever, one end of said first lever being slidably held by a supporting member, the other end of said first lever being pivotably held by the back surface of said keytop;

a second lever, one end of said second lever being pivotably held by said supporting member, the other end of said second lever being slidably held by the back surface of said keytop; and a dome-shaped elastic member placed on an insulating substrate, the elastic member having a top portion, a recess and a projecting portion, the recess having a bottom portion;

wherein said first and second levers are combined with each other via a shaft such that they cross each other; said elastic member is located in a hollow formed in said first or second lever; the top portion of said elastic member is in contact with said pedestal on the back surface of said keytop: and the projection is disposed within the recess of the elastic member such that a space is formed between the projection and the bottom portion of the recess, whereby when the keytop is depressed the projection contacts the bottom portion of the recess thereby pushing the projecting portion downward.

* * * * *

UNITED STATES PATENT AND TRADEMARK OFFICE

CERTIFICATE OF CORRECTION

PATENT NO. : 5,967,298

DATED : October 19, 1999

INVENTOR(S) : K. Watanabe et al.

It is certified that error appears in the above-indentified patent and that said Letters Patent is hereby corrected as shown below:

In the Claims

In claim 1, line 6, change "have" to --having--.

Signed and Sealed this

Fifth Day of September, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,967,298
DATED : October 19, 1999
INVENTOR(S) : Kazutoshi Watanabe et al.

It is certified that error appears in the above-identified patent and that said Letters Patent is hereby corrected as shown below:

Title page, item [73],
Under Assignee, change "ALSP ELECTRIC CO., LTD., Tokyo, Japan" to -- ALPS ELECTRIC CO., LTD., Tokyo, Japan --

Signed and Sealed this

Second Day of October, 2001

*Attest:*

Nicholas P. Godici

NICHOLAS P. GODICI
*Acting Director of the United States Patent and Trademark Office*

*Attesting Officer*